US005541721A

United States Patent [19]

Scheuer et al.

[11] Patent Number: 5,541,721

[45] Date of Patent: Jul. 30, 1996

[54] SYSTEM FOR CONTROLLING ELECTROSTATIC VOLTMETERS IN A TRI-LEVEL HIGHLIGHT COLOR XEROGRAPHIC PRINTER

[75] Inventors: Mark A. Scheuer, Williamson; Daniel W. MacDonald, Macedon, both of N.Y.

[73] Assignee: Xerox Corporation, Stamford, Conn.

[21] Appl. No.: 355,745

[22] Filed: Dec. 14, 1994

[51] Int. Cl.[6] ..... G03G 15/01; G03G 21/00

[52] U.S. Cl. ..... 355/326 R; 355/208

[58] Field of Search ..... 355/203, 208, 355/219, 246, 326 R–328

[56] References Cited

U.S. PATENT DOCUMENTS

| | | | |
|---|---|---|---|
| 4,078,929 | 3/1978 | Gundlach | 96/1.2 |
| 5,119,131 | 6/1992 | Paolini et al. | 355/208 |
| 5,132,730 | 7/1992 | Hurwitch et al. | 355/206 |
| 5,157,441 | 10/1992 | Scheuer et al. | 355/208 |
| 5,208,632 | 5/1993 | Hurwitch et al. | 355/208 |
| 5,285,241 | 2/1994 | Scheuer | 355/208 |

*Primary Examiner*—William J. Royer
*Attorney, Agent, or Firm*—R. Hutter

[57] ABSTRACT

In a xerographic printer for tri-level highlight color imaging, two electrostatic voltmeters (ESVs) are used to interpolate the electrostatic potential at a particular location along the path of the photoreceptor belt. Anomalous ESV readings, such as would be caused by dirt interfering with the ESV itself as opposed to systemic changes in the whole apparatus, are detected by having the printer enter a "test mode" in which test patches having minimal charge are monitored by the ESVs. The low-charge test patches enable noise related directly to the ESVs to be isolated from other possible sources of noise. The noise which results from ESV malfunctioning is compensated for when the printer returns to operation.

9 Claims, 5 Drawing Sheets

Figure 1A:
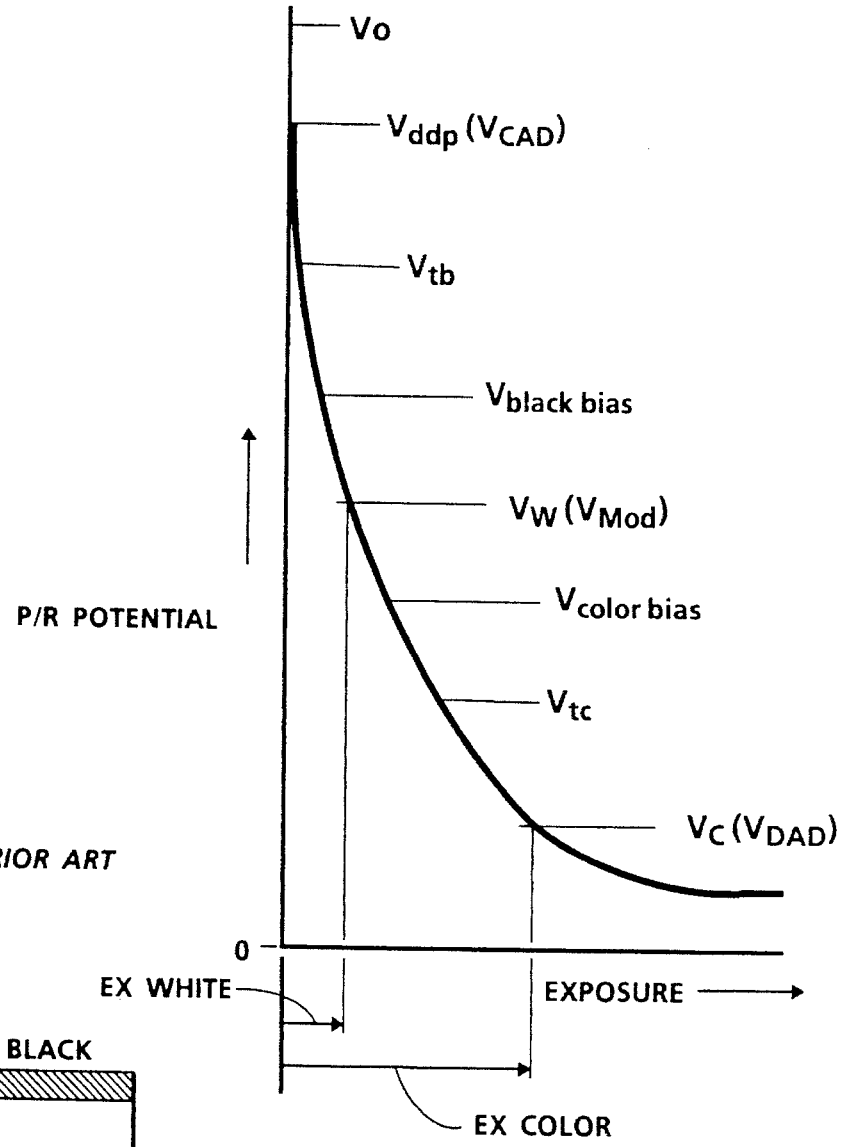
PRIOR ART FIG. 1a

SYSTEM FOR CONTROLLING ELECTROSTATIC VOLTMETERS IN A TRI-LEVEL HIGHLIGHT COLOR XEROGRAPHIC PRINTER

The present application incorporates by reference the following U.S. Pat. Nos.: 5,132,730; 5,157,441; and 5,208,632, all assigned to the assignee hereof.

This invention relates generally to tri-level xerography for highlight color imaging and more particularly to a control system having multiple electrostatic voltmeters.

In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation. This charge pattern is made visible by developing it with toner. The toner is generally a colored powder which adheres to the charge pattern by electrostatic attraction. The developed image is then fixed to the imaging surface or is transferred to a receiving substrate such as plain paper to which it is fixed by suitable fusing techniques.

The concept of tri-level, highlight color xerography is described in U.S. Pat. No. 4,078,929 to Gundlach. Gundlach teaches the use of tri-level xerography as a means to achieve single-pass highlight color imaging. As disclosed therein the charge pattern is developed with toner particles of first and second colors. The toner particles of one color are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided into three levels, rather than two levels as is the case in conventional xerography. The photoreceptor is typically initally charged to −900 volts. It is exposed imagewise, such that one image corresponding to charged image areas (which are subsequently developed by charged-area development, i.e. CAD) stays at the full photoreceptor potential ($V_{cad}$ or $V_{ddp}$). $V_{ddp}$ is the voltage on the photoreceptor due to the loss of voltage while the P/R remains charged in the absence of light, otherwise known as dark decay. The other image is exposed to discharge the photoreceptor to its residual potential, i.e. $V_{dad}$ or $V_c$ (typically −100 volts) which corresponds to discharged area images that are subsequently developed by discharged-area development (DAD) and the background area is exposed such as to reduce the photoreceptor potential to halfway between the $V_{cad}$ and $V_{dad}$ potentials, (typically −500 volts) and is referred to as $V_{white}$ or $V_w$ or $V_{Mod}$. The CAD developer is typically biased about 100 volts closer to $V_{cad}$ than $V_{white}$ (about −600 volts), and the DAD developer system is biased about −100 volts closer to $V_{dad}$ than $V_{white}$ (about 400 volts). As will be appreciated, the highlight color need not be a different color but may have other distinguishing characteristics. For, example, one toner may be magnetic and the other non-magnetic.

In the patents incorporated by reference above, which describe certain practical embodiments of a tri-level xerographic printing apparatus, there is disclosed a system in which the various electrostatic potentials are monitored by two electrostatic voltmeters. These electrostatic voltmeters are adapted to measure the electrostatic potential of particular areas on the moving photoreceptor at various locations, each location corresponding to a particular time in the xerographic process. In the above-referenced patents, one such voltmeter is disposed along the process direction of the moving photoreceptor at a location between the raster output scanner (ROS), which discharges the charged photoreceptor according to imagewise digital data, and the first development unit for CAD development. The second electrostatic voltmeter is disposed between the first or CAD development unit and before the second or DAD development unit. These electrostatic voltmeters are intended to operate control systems which ensure that the proper electrostatic charge level is placed on the photoreceptor as a particular photoreceptor area enters a development unit.

In practical use of such apparatus, however, it has been found that these electrostatic voltmeters cannot always produce accurate measurements of electrostatic potential on the moving photoreceptor. In particular, the second electrostatic voltmeter, which is effectively disposed between two development units, is likely to attract stray toner particles from one or the other development unit, and these stray toner particles interfere with the second voltmeter and then present a significant source of noise. Typically, in a properly working apparatus, the electrostatic voltage from a particular area on the photoreceptor should be slightly closer to zero at the second voltmeter relative to the first voltmeter, because of inevitable "dark decay" which causes an otherwise undisturbed charge on a photoreceptor to steadily decrease over time. This dark decay of charge on a particular area on the photoreceptor as the area moves along the process direction of the photoreceptor is predictable, and can be taken into account by the printer's control system. However, with the second electrostatic voltmeter being subject to dirt, which creates a noisy signal from the second voltmeter, this usually predictable relationship between the readings of the two voltmeters becomes unpredictable. Indeed, it is possible that, with noise, the second electrostatic voltmeter will read a higher absolute charge than the first electrostatic voltmeter, which is extremely unlikely, given that the charge initially placed on an area of the photoreceptor can only decay toward zero.

A patent incorporated by reference, U.S. Pat. No. 5,132,730, discloses a system in which the difference between the readings from two electrostatic voltmeters is compared to an arbitrary target value and a machine cycle down is initiated if the difference is greater than the target. In this way, sources of noise, such as from airborne toner particles, which significantly interfere with the operation of $ESV_2$ will be recognized as a malfunction of $ESV_2$ and the effect of these improper readings from $ESV_2$ will not be allowed to spread to the control system controlling overall print quality.

According to one aspect of the present invention, there is provided a method of controlling an electrostatographic printing apparatus having a charge receptor for bearing electrostatic images, a charger for placing a charge on the charge receptor, and an electrostatic voltmeter for measuring an electrostatic charge on the charge receptor. A charge of a first magnitude is placed on a preselected area of the charge receptor, and an electrostatic charge of the area of the charge receptor is measured. When the measured electrostatic charge is not within a predetermined acceptable range, a charge of a second magnitude is placed on a preselected area of the charge receptor. An electrostatic charge of the area of the charge receptor created by the charge of the second magnitude is measured. An offset for subsequent charge measurements by the electrostatic voltmeter is determined, based on the measured electrostatic charge resulting from the charge of the second magnitude.

According to another aspect of the present invention, there is provided a method of controlling an electrostatographic printing apparatus having a charge receptor for bearing electrostatic images, the charge receptor being movable in a process direction, a charger for placing a charge on the photoreceptor, a first electrostatic voltmeter for measuring an electrostatic charge on the charge receptor at a first position along the process direction downstream of the charger, a second electrostatic voltmeter for measuring an electrostatic charge on the charge receptor at a second position along the process direction downstream of the first position. A charge of a first magnitude is placed on a preselected area of the charge receptor, the first magnitude being suitable for creating a portion of an image. An electrostatic charge is measured of the area of the charge receptor at the first position and at the second position, and a difference in charge measurements by the first electrostatic voltmeter and the second electrostatic voltmeter is determined. When the difference is not within a predetermined acceptable range, a charge of a second magnitude is placed on a preselected test area of the charge receptor, and an electrostatic charge of the test area of the charge receptor at the first position and at the second position is measured, based on the charge of the second magnitude. An offset in charge measurements by the first electrostatic voltmeter and the second electrostatic voltmeter is determined, based on a difference in charge measurements by the first electrostatic voltmeter and the second electrostatic voltmeter resulting from measuring the area having the charge of the second magnitude.

Figure 1B:
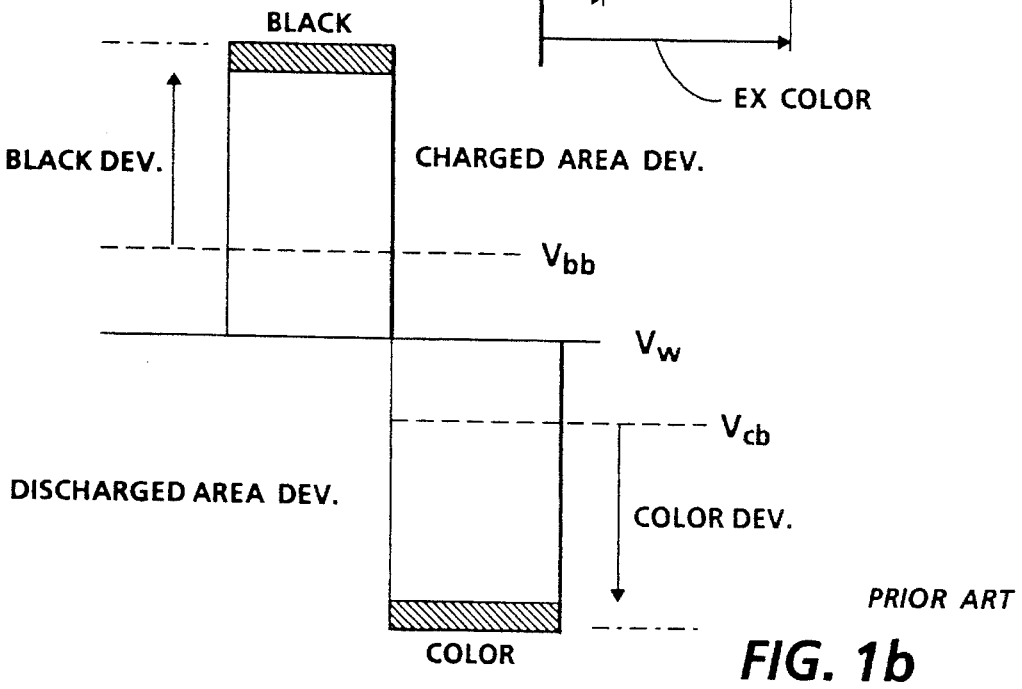
PRIOR ART FIG. 1b
Figure 2:
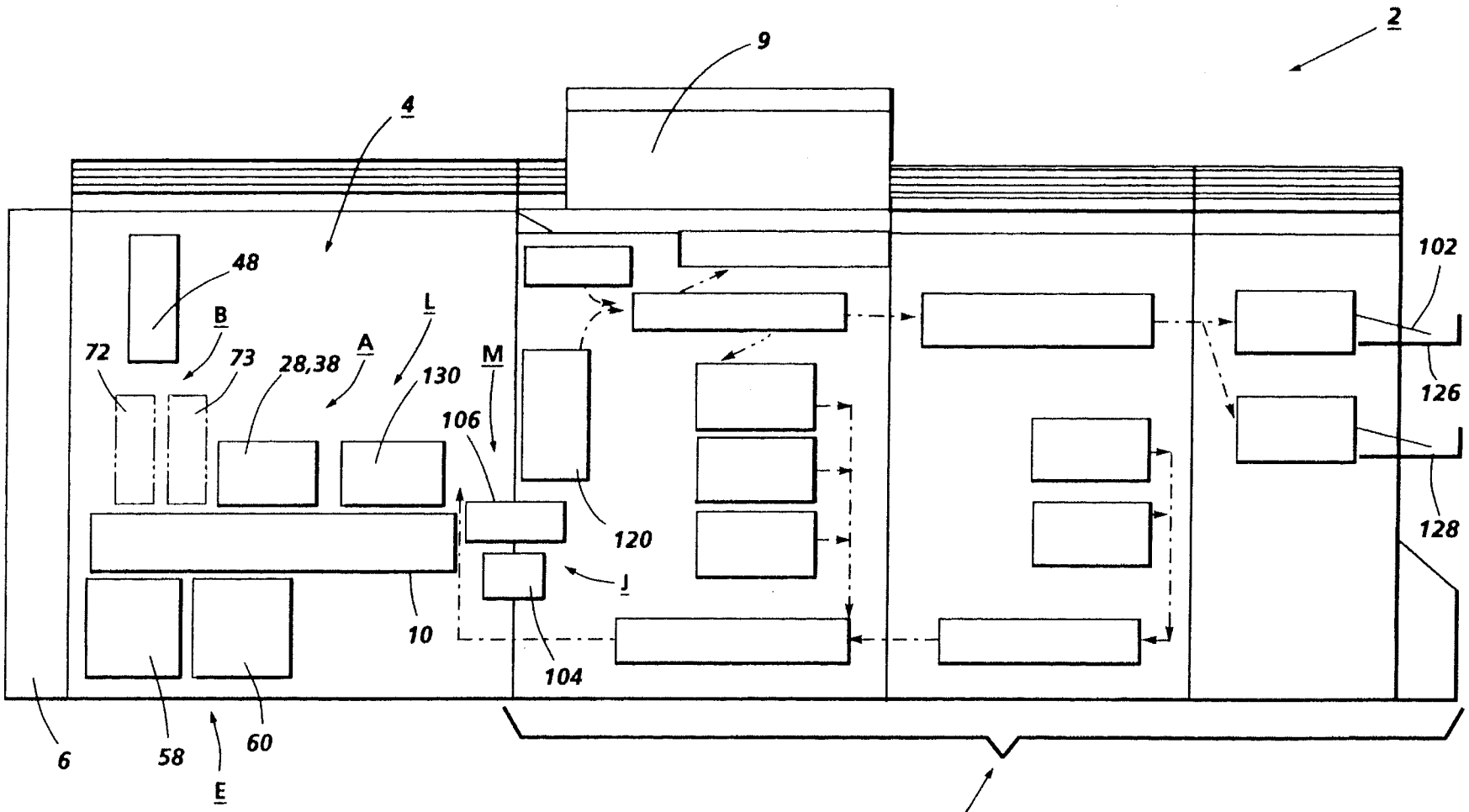
PRIOR ART FIG. 2
Figure 3:
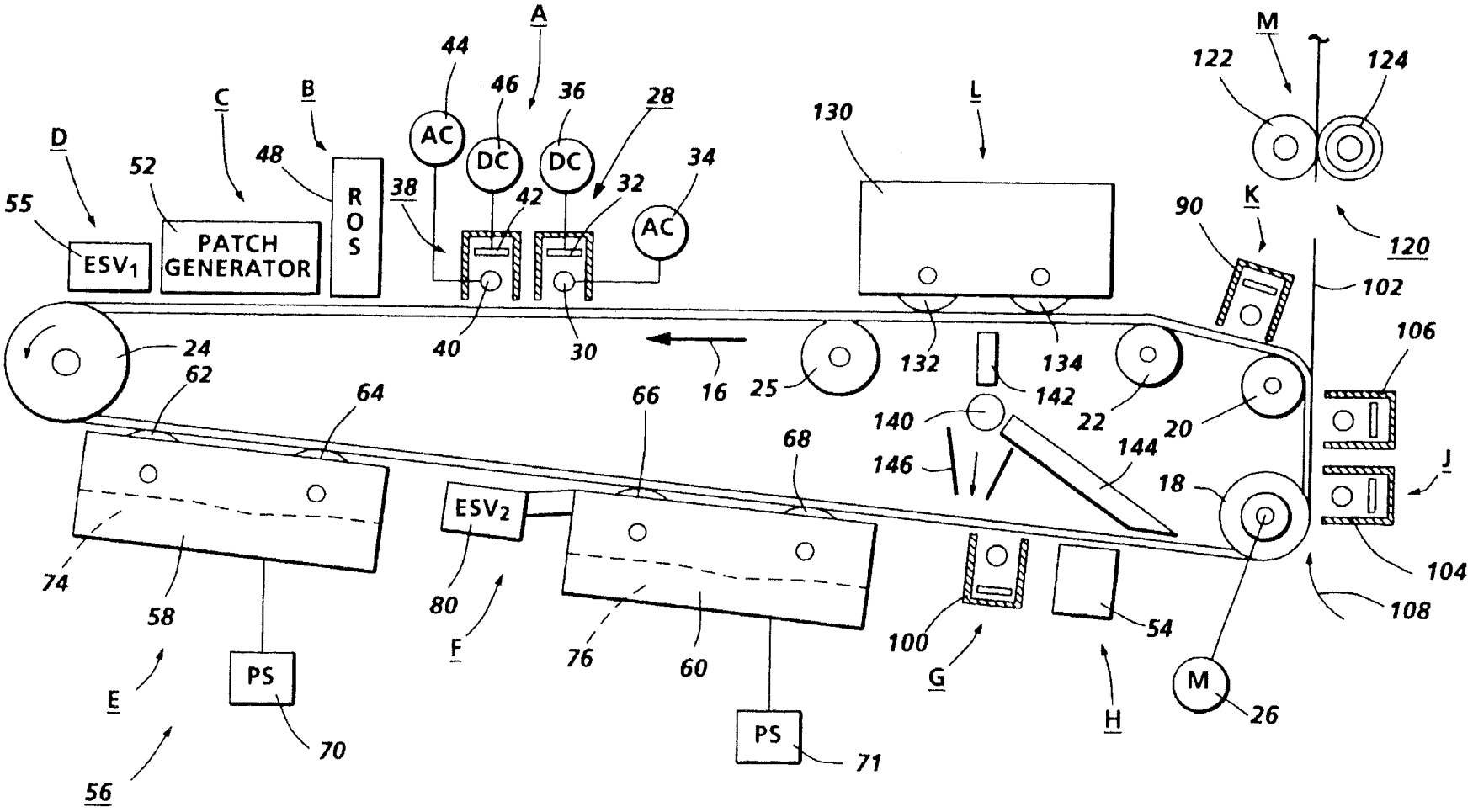
FIG. 3 PRIOR ART
Figure 4:
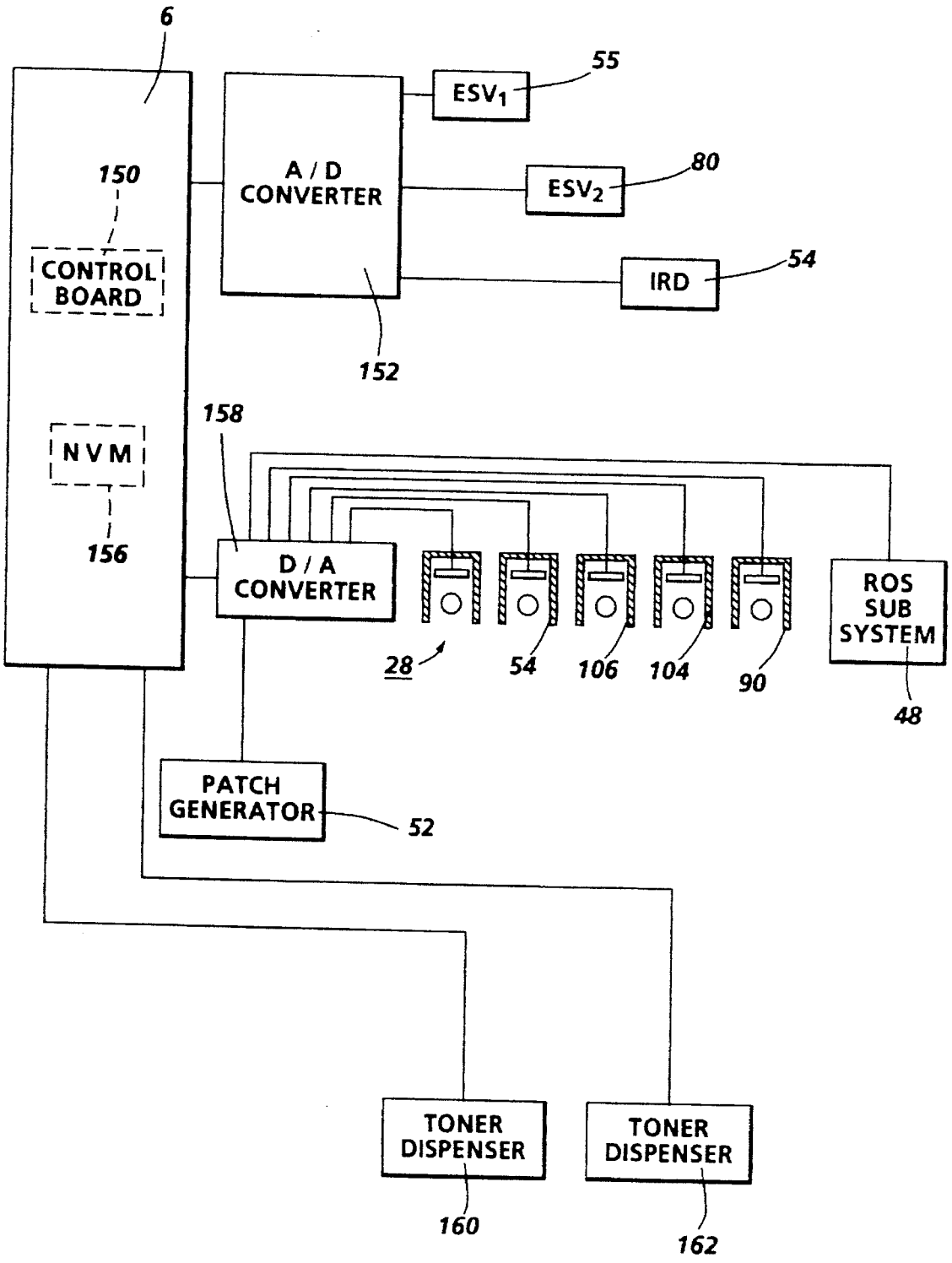
FIG. 4 PRIOR ART
Figure 5:
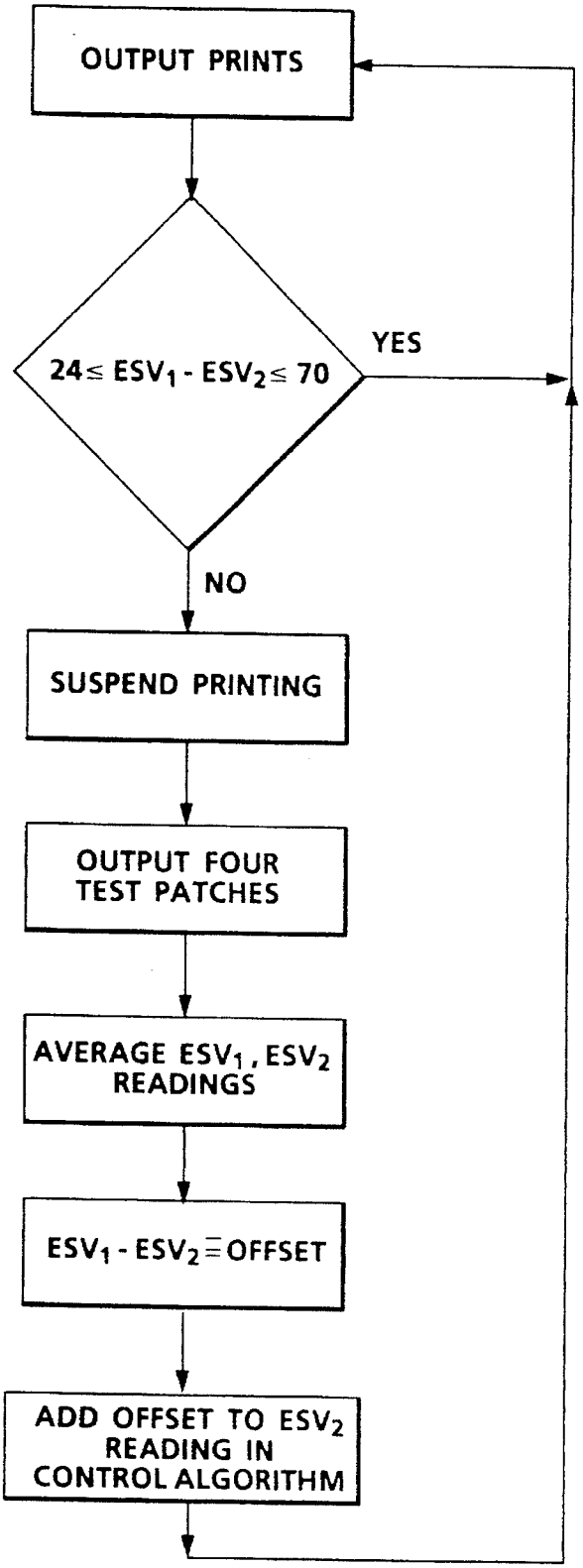

In the drawings:

FIG. 1*a* is a plot of photoreceptor potential versus exposure illustrating a tri-level electrostatic latent image;

FIG. 1*b* is a plot of photoreceptor potential illustrating single-pass, highlight color patent image characteristics;

FIG. 2 is schematic illustration of a printing apparatus incorporating the inventive features of the invention;

FIG. 3 a schematic of the xerographic process stations including the active members for image formation as well as the control members operatively associated therewith of the printing apparatus illustrated in FIG. 2;

FIG. 4 is a block diagram illustrating the interconnection among active components of the xerographic process module and the control devices utilized to control them; and FIG. 5 is a flowchart describing one embodiment of the method according to the present invention.

For a better understanding of the concept of tri-level, highlight color imaging, a description thereof will now be made with reference to FIGS. 1*a* and 1*b*. FIG. 1*a* shows a PhotoInduced Discharge Curve (PIDC) for a tri-level electrostatic latent image according to the present invention. Here $V_0$ is the initial charge level, $V_{ddp}$ ($V_{CAD}$) the dark discharge potential (unexposed), $V_w$ ($V_{Mod}$) the white or background discharge level and $V_c$ ($V_{DAD}$) the photoreceptor residual potential (full exposure using a three level Raster Output Scanner, or ROS).

Color discrimination in the development of the electrostatic latent image is achieved when passing the photoreceptor through two developer housings in tandem or in a single pass by electrically biasing the housings to voltages which are offset from the background voltage $V_{Mod}$, the direction of offset depending on the polarity or sign of toner in the housing. One housing (for the sake of illustration, the second) contains developer with black toner having triboelectric properties (positively charged) such that the toner is driven to the most highly charged ($V_{ddp}$) areas of the latent image by the electrostatic field between the photoreceptor and the development rolls biased at $V_{black\ bias}$ ($V_{bb}$) as shown in FIG. 1*b*. Conversely, the triboelectric charge (negative charge) on the colored toner in the first housing is chosen so that the toner is urged towards parts of the latent image at residual potential, $V_{DAD}$ by the electrostatic field existing between the photoreceptor and the development rolls in the first housing which are biased to $V_{color\ bias}$, ($V_{cb}$).

As shown in FIGS. 2 and 3, a highlight color printing apparatus 2 in which the invention may be utilized comprises a xerographic processor module 4, an electronics module 6, a paper handling module 8 and a user interface (IC) 9. A charge retentive member in the form of an Active Matrix (AMAT) photoreceptor belt 10, referred to in the claims hereinbelow as a "charge receptor," is mounted for movement in an endless path past a charging station A, an exposure station B, a test patch generator station C, a first Electrostatic Voltmeter (ESV) station D, a developer station E, a second ESV station F within the developer station E, a pretransfer station G, a toner patch reading station H where developed toner patches are sensed, a transfer station J, a preclean station K, cleaning station L and a fusing station M. Photoreceptor belt 10 moves in the direction of arrow 16 to advance successive portions thereof sequentially through the various processing stations disposed about the path of movement thereof. Belt 10 is entrained about a plurality of rollers 18, 20, 22, 24 and 25, the former of which can be used as a drive roller and the latter of which can be used to provide suitable tensioning of the photoreceptor belt 10. Motor 26 rotates roller 18 to advance belt 10 in the direction of arrow 16. Roller 18 is coupled to motor 26 by suitable means such as a belt drive, not shown. The photoreceptor belt may comprise a flexible belt photoreceptor.

As can be seen by further reference to FIGS. 2 and 3, initially successive portions of photoreceptor belt 10 pass through charging station A. At charging station A, a primary corona discharge device in the form of dicorotron indicated generally by the reference numeral 28, charges the surface of photoreceptor 10 to a selectively high uniform negative potential, $V_0$. In the claims hereinbelow, such a device for creating an initial charge on the photoreceptor 10 is referred to as a "charger." As noted above, the initial charge decays to a dark decay discharge voltage, $V_{ddp}$, ($V_{CAD}$). The dicorotron is a corona discharge device including a corona discharge electrode 30 and a conductive shield 32 located adjacent the electrode. The electrode is coated with relatively thick dielectric material. An AC voltage is applied to the dielectrically coated electrode via power source 34 and a DC voltage is applied to the shield 32 via a DC power supply 36. The delivery of charge to the photoconductive surface is accomplished by means of a displacement current or capacitative coupling through the dielectric material. The flow of charge to the P/R 10 is regulated by means of the DC bias applied to the dicorotron shield. In other words, the P/R will be charged to the voltage applied to the shield 32.

A feedback dicorotron 38 comprising a dielectrically coated electrode 40 and a conductive shield 42 operatively interacts with the dicorotron 28 to form an integrated charging device (ICD). An AC power supply 44 is operatively connected to the electrode 40 and a DC power supply 46 is operatively connected to the conductive shield 42.

Next, the charged portions of the photoreceptor surface are advanced through exposure station B. At exposure station B, the uniformly charged photoreceptor or charge retentive surface 10 is exposed to a laser based input and/or output scanning device 48 which causes the charge retentive surface to be discharged in accordance with the output from the scanning device. Preferably the scanning device is a three level laser Raster Output Scanner (ROS). Alternatively, the ROS could be replaced by a conventional xerographic exposure device. The ROS comprises optics, sensors, laser tube and resident control or pixel board.

The photoreceptor, which is initially charged to a voltage $V_0$, undergoes dark decay to a level $V_{ddp}$ or $V_{CAD}$ equal to about −900 volts to form CAD images. When exposed at the exposure station B it is discharged to $V_c$ or $V_{DAD}$ equal to about −100 volts to form a DAD image which is near zero or ground potential in the highlight color (i.e. color other than black) parts of the image. See FIG. 1*a*. The photoreceptor is also discharged to $V_w$ or $V_{mod}$ equal to approximately minus 500 volts in the background (white) areas.

A patch generator 52 (FIGS. 3 and 4) in the form of a conventional exposure device utilized for such purpose is positioned at the patch generation station C. It serves to create toner test patches in the interdocument zone which are used both in a developed and undeveloped condition for controlling various process functions. An Infra-Red densitometer (IRD) 54 is utilized to sense or measure the reflectance of test patches after they have been developed.

After patch generation, the P/R is moved through a first ESV station D where an ESV ($ESV_1$) 55 is positioned for sensing or reading certain electrostatic charge levels (i.e. $V_{DAD}$, $V_{CAD}$, $V_{Mod}$, and $V_{tc}$) on the P/R prior to movement of these areas of the P/R moving through the development station E.

At development station E, a magnetic brush development system, indicated generally by the reference numeral 56 advances developer materials into contact with the electrostatic latent images on the P/R. The development system 56 comprises first and second developer housing structures 58 and 60. Preferably, each magnetic brush development housing includes a pair of magnetic brush developer rollers. Thus, the housing 58 contains a pair of rollers 62, 64 while the housing 60 contains a pair of magnetic brush rollers 66, 68. Each pair of rollers advances its respective developer material into contact with the latent image. Appropriate developer biasing is accomplished via power supplies 70 and 71 electrically connected to respective developer housings 58 and 60. A pair of toner replenishment devices 72 and 73 (FIG. 2) are provided for replacing the toner as it is depleted from the developer housing structures 58 and 60.

Color discrimination in the development of the electrostatic latent image is achieved by passing the photoreceptor past the two developer housings 58 and 60 in a single pass with the magnetic brush rolls 62, 64, 66 and 68 electrically biased to voltages which are offset from the background voltage $V_{Mod}$, the direction of offset depending on the polarity of toner in the housing. One housing e.g. 58 (for the sake of illustration, the first) contains red conductive magnetic brush (CMB) developer 74 having triboelectric properties (i.e. negative charge) such that it is driven to the least highly charged areas at the potential $V_{DAD}$ of the latent images by the electrostatic development field ($V_{DAD}-V_{color\ bias}$) between the photoreceptor and the development rolls 62, 64. These rolls are biased using a chopped DC bias via power supply 70.

The triboelectric charge on conductive black magnetic brush developer 76 in the second housing is chosen so that the black toner is urged towards the parts of the latent images at the most highly charged potential $V_{CAD}$ by the electrostatic development field ($V_{CAD}-V_{black\ bias}$) existing between the photoreceptor and the development rolls 66, 68. These rolls, like the rolls 62, 64, are also biased using a chopped DC bias via power supply 71. By chopped DC (CDC) bias is meant that the housing bias applied to the developer housing is alternated between two potentials, one that represents roughly the normal bias for the DAD developer, and the other that represents a bias that is considerably more negative than the normal bias, the former being identified as $V_{Bias\ Low}$ and the latter as $V_{Bias\ High}$. This alternation of the bias takes place in a periodic fashion at a given frequency, with the period of each cycle divided up between the two bias levels at a duty cycle of from 5–10% (Percent of cycle at $V_{Bias\ High}$) and 90–95% at $V_{Bias\ Low}$. In the case of the CAD image, the amplitude of both $V_{Bias\ Low}$ and $V_{Bias\ High}$ are about the same as for the DAD housing case, but the waveform is inverted in the sense that the the bias on the CAD housing is at $V_{Bias\ High}$ for a duty cycle of 90–95%. Developer bias switching between $V_{Bias\ High}$ and $V_{Bias\ Low}$ is effected automatically via the power supplies 70 and 71.

In contrast, in conventional tri-level imaging as noted above, the CAD and DAD developer housing biases are set at a single value which is offset from the background voltage by approximately −100 volts. During image development, a single developer bias voltage is continuously applied to each of the developer structures. Expressed differently, the bias for each developer structure has a duty cycle of 100%.

Because the composite image developed on the photoreceptor consists of both positive and negative toner, a negative pretransfer dicorotron member 100 at the pretransfer station G is provided to condition the toner for effective transfer to a substrate using positive corona discharge.

Subsequent to image development a sheet of support material 102 (FIG. 3) is moved into contact with the toner image at transfer station J. The sheet of support material is advanced to transfer station J by conventional sheet feeding apparatus comprising a part of the paper handling module 8. Preferably, the sheet feeding apparatus includes a feed roll contacting the uppermost sheet of a stack copy sheets. The feed rolls rotate so as to advance the uppermost sheet from the stack into a chute which directs the advancing sheet of support material into contact with the photoconductive surface of belt 10 in a timed sequence so that the toner powder image developed thereon contacts the advancing sheet of support material at transfer station J.

Transfer station J includes a transfer dicorotron 104 which sprays positive ions onto the backside of sheet 102. This attracts the negatively charged toner powder images from the belt 10 to sheet 102. A detack dicorotron 106 is also provided for facilitating stripping of the sheets from the belt 10.

After transfer, the sheet continues to move, in the direction of arrow 108, onto a conveyor (not shown) which advances the sheet to fusing station M. Fusing station M includes a fuser assembly, indicated generally by the reference numeral 120, which permanently affixes the transferred powder image to sheet 102. Preferably, fuser assembly 120 comprises a heated fuser roller 122 and a backup roller 124. Sheet 102 passes between fuser roller 122 and backup roller 124 with the toner powder image contacting fuser roller 122. In this manner, the toner powder image is permanently affixed to sheet 102 after it is allowed to cool. After fusing, a chute, not shown, guides the advancing sheets 102 to catch trays 126 and 128 (FIG. 2), for subsequent removal from the printing machine by the operator.

After the sheet of support material is separated from the photoconductive surface of belt 10, the residual toner particles carried by the non-image areas on the photoconductive surface are removed therefrom. These particles are removed at cleaning station L. A cleaning housing 130 supports therewithin two cleaning brushes 132, 134 supported for counter-rotation with respect to the other and each supported in cleaning relationship with photoreceptor belt 10. Each brush 132, 134 is generally cylindrical in shape, with a long axis arranged generally parallel to photoreceptor belt 10, and transverse to photoreceptor movement direction 16. Brushes 132,134 each have a large number of insulative fibers mounted on a base, each base respectively journaled for rotation (driving elements not shown). The brushes are typically detoned using a flicker bar and the toner so removed is transported with air moved by a vacuum source (not shown) through the gap between the housing and photoreceptor belt 10, through the insulative fibers and exhausted through a channel, not shown. A typical brush rotation speed is 1300 rpm, and the brush/photoreceptor interference is usually about 2 mm. Brushes 132, 134 beat against flicker bars (not shown) for the release of toner carried by the brushes and for effecting suitable tribo charging of the brush fibers.

Subsequent to cleaning, a discharge lamp 140 floods the photoconductive surface 10 with light to dissipate any residual negative electrostatic charges remaining prior to the charging thereof for the successive imaging cycles. To this end, a light pipe 142 is provided. Another light pipe 144 serves to illuminate the backside of the P/R downstream of the pretransfer dicorotron 100. The P/R is also subjected to flood illumination from the lamp 140 via a light channel 146.

FIG. 4 depicts the the interconnection among active components of the xerographic process module 4 and the sensing or measuring devices utilized to control them. As illustrated therein, $ESV_1$ 55, $ESV_2$ 80 and IRD 54 are operatively connected to a control board 150 through an analog to digital (A/D) converter 152. $ESV_1$ and $ESV_2$ produce analog readings in the range of 0 to 10 volts which are converted by Analog to Digital (A/D) converter 152 to digital values in the range 0–255. Each bit corresponds to 0.040 volts (10/255) which is equivalent to photoreceptor voltages in the range 0–1500 where one bit equals 5.88 volts (1500/255).

The digital value corresponding to the analog measurements are processed in conjunction with a Non-Volatile Memory (NVM) 156 by firmware forming a part of the control board 150. The digital values arrived at are converted by a digital to analog (D/A) converter 158 for use in controlling the ROS 48, dicorotrons 28, 54, 90, 104 and 106. Toner dispensers 160 and 162 are controlled by the digital values. Target values for use in setting and adjusting the operation of the active machine components are stored in NVM.

A well known problem with standard xerographic photoreceptors is that there is a loss of voltage while the P/R remains charged in the absence of light. This loss, known as dark decay, depends on both the magnitude of the initial voltage, $V_0$ to which the P/R is charged and the amount of time that the P/R remains in the dark. In single ESV control systems (i.e., in the Xerox model "5090" printer) the amount of dark decay is inferred from the charge dicorotron setting and an ESV reading. The dark decay is projected to the developer housing and the system electrostatics are adjusted accordingly. Thus, as the P/R ages and more voltage is applied by the charging system, the assumed amount of dark decay increases and the charging level is further increased. In a standard "bi-level" (one image charge level and a background charge level) xerographic system only the charge level suffers large dark decay. The dark decay for the background voltage is relatively small because of the much lower voltage used (following exposure). The black toner patch voltage is not controlled in the "5090" but the charge level dark decay is used to adjust IRD readings of the toner patch.

In a tri-level system the dark decay of the intermediate background voltage is also quite appreciable. Using only one ESV, an approximate dark decay for this voltage can be calculated by measuring the dark decay for the charge level and projecting to the black developer using a projection scheme very similar to that used in the "5090." The dark decay for other voltages (background, color development, and both black and color toner patch voltages) are based on a fraction of the charge level dark decay. The dark decay for the color development was small and could have been neglected. The problem with this approach for a tri-level system is dealing with the voltage loss to the black development field as it passes through the color developer material. It is impossible to separate this voltage loss from the system dark decay in an accurate manner.

Using $ESV_2$, the CAD image voltage, $V_{CAD}$ and black toner patch voltage, $V_{tb}$ are measured after the dark decay and voltage loss has occurred, the latter from partial charge neutralization of the CAD image as it passes through the DAD developer housing. The DAD image voltage (color development) suffers little dark decay change over the life of the P/R so the average dark decay can simply be built into the voltage target. Only the dark decay for the intermediate background level voltage, $V_{Mod}$ and the color toner patch voltage, $V_{tc}$ have to be adjusted.

Analysis of data from several different AMAT photoreceptors indicates a correlation between the dark decay for two different voltages:

a. Charge at 1000 volts then exposed to 450 volts b. Charge at 1000 volts then exposed to 250 volts.

The correlation is given as:

$$\Delta V_2=\Delta V_1[3/(2+V_1/V_2)] \quad (1)$$

The nominal value for $V_{tc}$ is 247 volts at $ESV_1$. The nominal value for $V_{Mod}$ at the color housing is 450 volts. $V_{Mod}$ at $ESV_1$ is about 500 volts and $V_{Mod}$ at $ESV_2$ is about 425 volts. For these nominal values, the constant in equation (1) is 0.745.

In controlling the intermediate voltage, $V_{Mod}$ readings are made using both $ESV_1$ and $ESV_2$ and an interpolation is made between the two readings to control the background voltage, $V_{Mod}$ at the color development housing. Since the dark decay affects both readings, the voltage at the color housing is automatically adjusted as the dark decay changes over the life of the P/R. Based on the relative positions of $ESV_1$, $ESV_2$, and the color housing as well as the speed (i.e. 206.7 mm/sec) of the P/R, the background voltage ($V_{Mod}$) at the color housing is calculated using:

$$V_{Mod}@Color=0.38\times V_{Mod}@ESV_1+0.62\times V_{Mod}@ESV_2$$

where:

$V_{Mod}$@Color is the background voltage level to be established by the exposure device or ROS 48 $V_{Mod}$@$ESV_1$ is the background voltage prior to its movement past the developer housing structure 58 $V_{Mod}$@$ESV_2$ is the background voltage after its movement past the developer housing structure 58 and 0.38 and 0.62 are determined as functions of the relative positions where the background voltage levels are sensed and the position of the first developer housing structure as well as the speed of the charge retentive surface.

The color toner patch voltage, $V_{tc}$ is a bit more complicated because the dark decay voltage reading at $ESV_2$ is not available because the development of the toner patch as it passes through the DAD or color developer housing changes the voltage level of the test patch. However, the dark decay of the color toner patch can be estimated from the dark decay of the intermediate background voltage level, $V_{Mod}$. With the current voltage setpoints, the toner patch dark decay is 0.75±0.05 of the intermediate background voltage level dark decay between $ESV_1$ and $ESV_2$. Thus the color toner patch voltage can be projected to the color developer housing using the $ESV_1$ and $ESV_2$ readings for $V_{Mod}$ and the $ESV_1$ reading for the color toner patch. The use of this algorithm reduces the voltage variations of the color toner patch from ±30 volts to ±4 volts over the expected range of P/R variabilities.

The use of a ratio of dark decays in controlling the color toner patch voltage differs from using a single ESV for calculating an approximate dark decay, in that:

a. it uses readings of an exposed P/R state ($V_{Mod}$) instead of simply the charged state, b. it uses two actual measurements of P/R voltage ($V_{Mod}$@1 and $V_{Mod}$@2) instead of a single ESV reading and an assumed voltage (that the charge on the P/R at the dicorotron is the same as the voltage applied to the dicorotron shield), c. it makes no assumptions about the functional relation between dark decay and time, again because two ESV readings are available.

d. it is relatively insensitive to the voltage loss as the P/R passes through the color developer material (the $V_{Mod}$ voltage loss is only about 10 volts; the charge area voltage loss can be as much as 150 volts)

The color patch voltage at the color housing is calculated according to:

$$\begin{aligned} V_{tc}@\text{Color} &= V_{tc}@ESV_1 - 0.465 \times (V_{Mod}@ESV_1 - V_{Mod}@\text{Color}) \\ &= V_{tc}@ESV_1 - 0.75 \times (0.62 \times V_{Mod}@ESV_1 - 0.62\, V_{Mod}@ESV_2) \\ &= V_{tc}@ESV_1 - 0.465 \times (V_{Mod}@ESV_1 - V_{Mod}@ESV_2) \end{aligned}$$

where $V_{tc}$ is the test patch voltage level to be created at the color housing by the ROS 48

$V_{tc}$@$ESV_1$ is the test patch voltage level prior to the test patch moving past the developer housing structure 58

0.75≡0.05 is a constant derived from test data.

and 0.465 is a constant selectable in non-volatile memory (NVM)

In operation, $ESV_1$ generates a first signal representative of $V_{Mod}$ voltage prior to its movement past the DAD housing 58. $ESV_2$ generates a second signal representative of $V_{Mod}$ voltage after it passes the DAD housing. $ESV_1$ generates a third signal at voltage $V_{tc}$ representative of the color test patch voltage prior to its movement past the DAD housing. These signals are then used in accordance with the foregoing formulas to determine the output of the ROS to arrive at the appropriate voltage level, $V_{Mod}$ at the DAD housing.

This interpolation of the value of $V_{Mod}$, in which much of the control of exposure and development in the printing apparatus is dependent, will of course require accurate readings from $ESV_1$ and $ESV_2$ in order to properly control the creation of images. In use in an apparatus such as that described here, the location of $ESV_2$ between the two developer housings 58 and 60 causes the $ESV_2$ to be exposed to a large quantity of stray or airborne toner particles. These stray toner particles tend to interfere with the correct reading by $ESV_2$ of the electrostatic voltage in particular areas of the photoreceptor 10. It will be evident that, as $ESV_1$ and $ESV_2$ are the primary sources of image-quality feedback for the charging, exposure, and development systems, highly anomalous readings from $ESV_2$ may cause "vicious cycles" of ever-poorer print quality as the system tries to compensate for print-quality defects which do not in fact exist.

According to the present invention, when the readings from $ESV_2$ are highly anomalous, the control system for the printing apparatus enters a "correction mode" in which potential sources of the anomalous readings are in effect isolated from one another. If it is determined that the source of the anomalous readings is $ESV_2$ itself and not a systemic problem with the whole apparatus, then the control system is recalibrated to take into account the improper behavior of $ESV_2$.

$V_{Mod}$, as mentioned above, corresponds to "white" portions of an electrostatic latent image. For the proper operation of a tri-level system, the measured difference of $V_{Mod}$ between $ESV_1$ and $ESV_2$ should be within a predetermined acceptable range, in order for the proper relationship of $V_{CAD}$, $V_{Mod}$, and $V_{DAD}$ to be maintained. In one known embodiment of a tri-level system similar to that described, a proper range of difference for $ESV_1$ and $ESV_2$ is less than 70 volts but more than 24 volts. As long as the difference between readings from $ESV_1$ and $ESV_2$ for $V_{Mod}$ is within this range, acceptable print quality will typically be maintained. Typically, in a practical apparatus, this difference remains within the proper range for thousands of prints.

The correction system of the present invention comes into play when the difference between $ESV_1$ and $ESV_2$ drifts out of this acceptable range. As electrostatic voltmeter $ESV_2$ becomes physically dirty as a result of stray or airborne particles from one or the other development units 58 or 60, the readings from $ESV_2$ drift upward. This upward drift is in itself unimportant, as long as the control system "knows" that the source of the drift is within $ESV_2$ itself and not the result of some systemic problem with the entire apparatus. As long as electrostatic voltmeter $ESV_2$ itself is the source of the drift, the drift can be compensated for.

An example of the upward drift of the readings from $ESV_2$ caused by the action of dirt on the electrostatic voltmeter 80 itself is receiving readings of $V_{Mod}$ of 330 volts at $ESV_1$ and readings of 320 volts at $ESV_2$ for the same area. As will be noted, this is outside the acceptable range of 24 volts–70 volts for a difference in readings. Upon detecting a condition in which the difference between the readings of $ESV_1$ and $ESV_2$ is out of the acceptable range, the system of the present invention enters a correction mode. Under this correction mode, the printing of images by the entire system is temporarily suspended so that the entire system can be recalibrated to compensate for the malfunctioning $ESV_2$.

The system of the present invention determines the amount of drift attributable to $ESV_2$ by examining the behavior of $ESV_2$ relative to $ESV_1$ when a relatively small amount of charge exists on the photoreceptor 10. When there is only a small amount of charge placed on a particular area of photoreceptor 10, the effect of dark decay, meaning the natural degradation of charges placed on the photoreceptor, will be minimized. By minimizing the effect of dark decay, which is a function of the behavior of the photoreceptor 10 itself, the particular behavior of the electrostatic voltmeters can be considered in isolation. In the correction mode, a series of test patches having this minimal charge is created on photoreceptor 10 while actual production of prints is suspended. These test patches of minimal charge are created by operating the ROS 48 in such a manner as to discharge the particular area of the test patch to the maximum extent of which ROS 48 is capable. Then, the electrostatic readings from $ESV_1$ and $ESV_2$ are taken of each minimally-charged test patch. Because very little dark decay is experienced by areas of low original potential, any difference in readings between $ESV_1$ and $ESV_2$ is very likely to be a function of the electrostatic voltmeters themselves.

To take a specific example, a series of four individual test patches of highly discharged areas are created by ROS 48, and the readings from each electrostatic voltmeter are averaged. In this example, it may be found that an average measured potential of the four test patches is 50 volts on $ESV_1$ and 88 volts on $ESV_2$. Based on this determination, the hypothesis is that $ESV_2$ has "drifted," because of the influence of dirt or other factors relating directly to $ESV_2$, by 38 volts. The "correction mode" is thus in effect an experiment in which the effects of dark decay of the photoreceptor 10 itself are minimized, revealing only the outputs of the electrostatic voltmeters themselves.

Once it is known that $ESV_2$ has drifted to a point where every reading is distorted upward by 38 volts, the system of the present invention can incorporate this information in the general control system of the whole printer when the apparatus is again used to output prints. After the test patches have been made and the necessary difference between readings from $ESV_1$ and $ESV_2$ are determined, the correction mode ends and the system goes back to outputting prints. With the return to printing mode, the system of the present invention subtracts 38 volts from every raw reading from $ESV_2$, in order to compensate for the upward drift on $ESV_2$. Thus, in the new print mode, a reading of 320 volts from $ESV_2$ is converted by subtracting the offset of 38 volts which is caused by $ESV_2$ itself, and a revised reading of 320–38=282 volts for $ESV_2$ is actually entered into the main control program of the printing apparatus. With the drift which is specific to $ESV_2$ taken into account, the regular control systems, influencing the initial charge, discharge, and development voltages of the entire system, can proceed as normal, as though $ESV_2$ had been "repaired." However, $ESV_2$ has not been repaired as much as its anomalous readings have been compensated for in the control system as a whole.

FIG. 5 is a flowchart which summarizes the action of the system of the present invention. It can be seen from the top of the flowchart, the basic state of the control system for the entire printing apparatus is maintained as long as prints are outputted, although the system is monitored constantly to make sure that the difference in readings between $ESV_1$ and $ESV_2$ is maintained in the acceptable range, which in this particular instance is from 24 to 70 volts. Once the difference in readings between voltmeters exceeds this amount, the system enters a "correction mode" in which the printing of images is temporarily suspended, and the ROS 48 is instructed to output four test patches of areas which are as completely discharged as is possible with the ROS 48. These four test patches are then monitored by $ESV_1$ and $ESV_2$, with the readings from each individual electrostatic voltmeter being averaged. The difference between the average readings from $ESV_1$ and the average readings from $ESV_2$ of these highly charged areas is defined as the "offset." This offset is then used to compensate for the differences in performance between $ESV_1$ and $ESV_2$. This compensation is facilitated by subtracting the offset from the readings from $ESV_2$ in the main control program of the printer when prints are being outputted. Once this offset is incorporated into the control algorithm for readings from $ESV_2$, the control system for the printing apparatus returns to the printing mode. This correction mode can occur in the course of printing a large number of prints, and the print run can resume after the correction mode, in a manner which is substantially invisible to the user; to an outside observer, this correction mode will appear as merely a brief pause in the course of outputting a print run.

A key principle of the present invention, the idea that noise originating from dirt or other malfunction in a particular ESV itself can be isolated from other possible sources of noise, can be generalized to a situation in which only one ESV is controlled. For example, if a practical design of a printing apparatus is such that it is extremely unlikely that $ESV_1$ would be the source of anomalous readings, or if the system were so robust that $ESV_1$ were not even necessary, the readings of $ESV_2$, or a single ESV in the position of $ESV_2$, could be compared to an absolute voltage level or range. Thus, instead of comparing the reading of $ESV_2$ to that of $ESV_1$ to see if the difference between two such readings are out of range, the system could be designed to enter its "correction mode" when the readings from $ESV_2$ are outside of an acceptable absolute range, such as from 250 to 350 volts. When such a system enters a "correction mode," a test patch of a known small charge is created by the ROS 48, and such a maximally-discharged area in a particular system may have an electrostatic potential which can be plausibly estimated in advance. As a design convenience, the charge of the test patch could be estimated as some likely number such as 5 volts. Thus, to determine the offset value for readings from the electrostatic voltmeter $ESV_2$ in this single-voltmeter system, the offset would be the reading by the electrostatic voltmeter of the discharged test patch, minus the pre-estimated residual charge on the discharged test patch. For example, if, in the "correction mode," a test patch is created and it is plausibly estimated that creation of the test patch will result in a residual charge of 5 volts on the test patch, a reading of 28 volts on electrostatic voltmeter $ESV_2$ will mandate an offset of 28–5=23 volts in subsequent readings from $ESV_2$ when the apparatus returns to printing mode. The point is that the noise-isolation principle on which the present invention is based can be adapted to a system having a single voltmeter, if certain assumptions about the behavior of the system as a whole are likely to be valid.

While the invention has been described with reference to the structure disclosed, it is not confined to the details set forth, but is intended to cover such modifications or changes as may come within the scope of the following claims.

We claim:

1. A method of controlling an electrostatographic printing apparatus having a charge receptor for bearing electrostatic images, a charger for placing a charge on the charge receptor, and an electrostatic voltmeter for measuring an electrostatic charge on the charge receptor, comprising the steps of:

placing a charge of a first magnitude on a preselected area of the charge receptor;

measuring an electrostatic charge of the area of the charge receptor;

when the measured electrostatic charge is not within a predetermined acceptable range, placing a charge of a second magnitude on a preselected area of the charge receptor;

measuring an electrostatic charge of the area of the charge receptor created by the charge of the second magnitude; and determining an offset for subsequent charge measurements by the electrostatic voltmeter, based on the measured electrostatic charge resulting from the charge of the second magnitude.

2. The method of claim 1, further comprising the steps of operating the electrostatographic printing apparatus according to a control system which accepts outputs from the electrostatic voltmeter;

mathematically altering an output of the electrostatic voltmeter according to the offset; and entering the altered output of the electrostatic voltmeter into the control system.

3. The method of claim 1, wherein the step of placing a charge of a second magnitude on a preselected area of the charge receptor includes the step of discharging the preselected area to a maximum possible extent.

4. The method of claim 3, wherein the step of determining an offset comprises the step of subtracting a constant charge value related to a predicted maximum possible extent of discharge of the charge receptor from a measurement resulting from the charge of the second magnitude.

5. A method of controlling an electrostatographic printing apparatus having a charge receptor for bearing electrostatic images, the charge receptor being movable in a process direction, a charger for placing a charge on the charge receptor, a first electrostatic voltmeter for measuring an electrostatic charge on the charge receptor at a first position along the process direction downstream of the charger, a second electrostatic voltmeter for measuring an electrostatic charge on the charge receptor at a second position along the process direction downstream of the first position, comprising the steps of:

placing a charge of a first magnitude on a preselected area of the charge receptor, the first magnitude being suitable for creating a portion of an image;

measuring an electrostatic charge of the area of the charge receptor at the first position and at the second position;

determining a difference in charge measurements by the first electrostatic voltmeter and the second electrostatic voltmeter;

when the difference is not within a predetermined acceptable range, placing a charge of a second magnitude on a preselected test area of the charge receptor;

measuring an electrostatic charge of the test area of the charge receptor at the first position and at the second position, based on the charge of the second magnitude; and determining an offset in charge measurements by the first electrostatic voltmeter and the second electrostatic voltmeter, based on a difference in charge measurements by the first electrostatic voltmeter and the second electrostatic voltmeter resulting from measuring the electrostatic charge on the area having the charge of the second magnitude.

6. The method of claim 5, further comprising the steps of operating the electrostatographic printing apparatus according to a control system which accepts outputs from the second electrostatic voltmeter;

mathematically altering an output of the second electrostatic voltmeter according to the offset; and entering the altered output of the second electrostatic voltmeter into the control system.

7. The method of claim 6, wherein the step of mathematically altering an output of the second electrostatic voltmeter includes the step of subtracting the offset from an output of the second electrostatic voltmeter.

8. The method of claim 5, wherein the printing apparatus includes a development unit disposed along the process direction between the first electrostatic voltmeter and the second electrostatic voltmeter.

9. The method of claim 5, wherein the step of placing a charge of a second magnitude on a preselected area of the charge receptor includes the step of discharging the area to a maximum possible extent.

* * * * *